United States Patent [19]

Helwig et al.

[11] 3,991,496

[45] Nov. 16, 1976

[54] GRAVITY BIAS FOR DISPLAY ELEMENTS

[75] Inventors: Gordon Helwig, Toronto; Donald Winrow, Weston, both of Canada

[73] Assignee: Ferranti-Packard Limited, Toronto, Canada

[22] Filed: July 31, 1975

[21] Appl. No.: 600,281

[52] U.S. Cl. ..... 40/28 C; 40/52 R
[51] Int. Cl.[2] ..... G09F 11/00
[58] Field of Search ..... 40/28 C, 52 R, 67

[56] References Cited

UNITED STATES PATENTS

| | | | |
|---|---|---|---|
| 1,191,023 | 7/1916 | Naylor | 40/28 C |
| 3,365,824 | 1/1968 | Winrow | 40/28 C |
| 3,624,941 | 12/1969 | Chantry | 40/52 R |
| 3,745,563 | 7/1973 | Jones et al. | 40/28 C |

*Primary Examiner*—Hugh R. Chamblee
*Assistant Examiner*—Wenceslao J. Contreras

[57] ABSTRACT

A disc rotatable to exhibit alternately one of its two faces under the influence of an external magnetic field, has its center of gravity offset with respect to the pivoting plane so as to ensure a positive torque when moving from either of its rest positions under the influence of the said magnetic field.

2 Claims, 3 Drawing Figures

FIG. 1
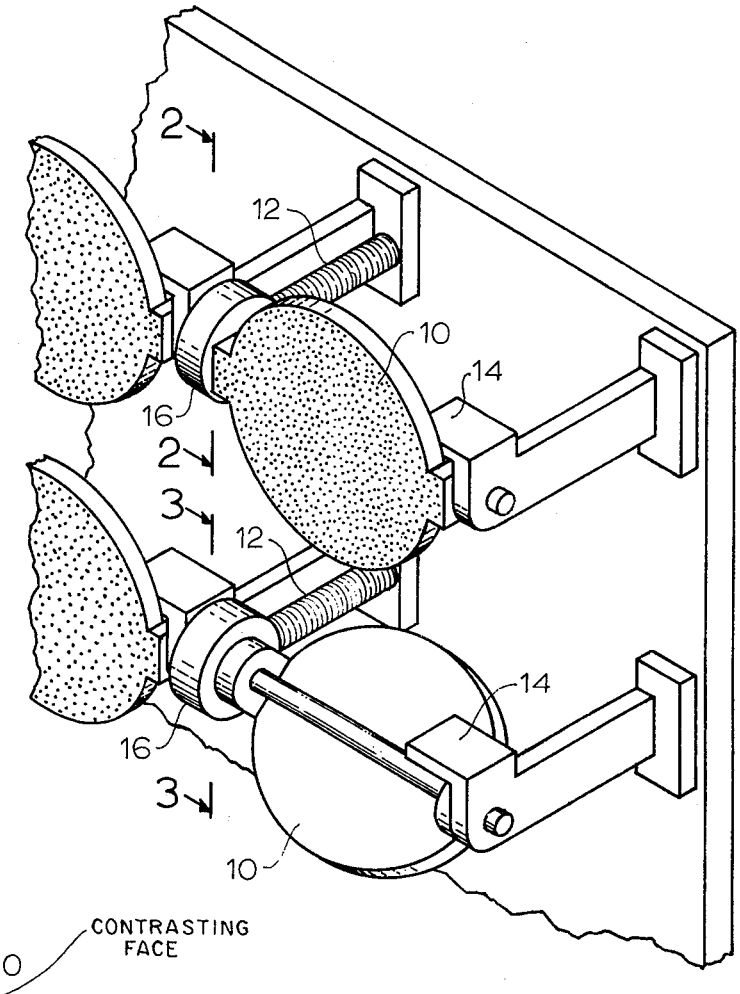
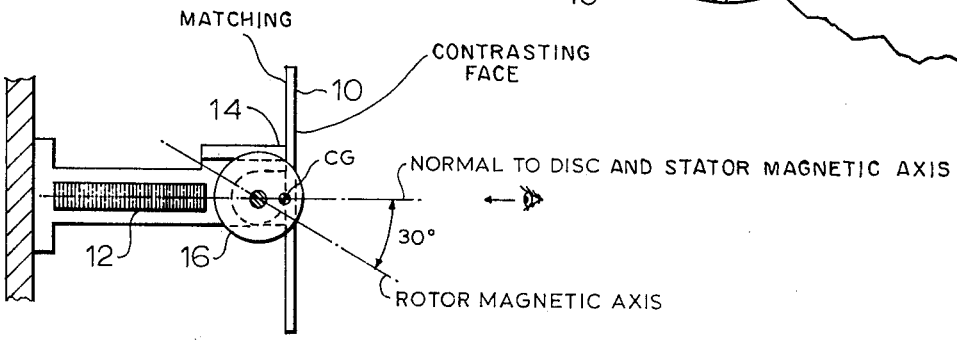
FIG. 2
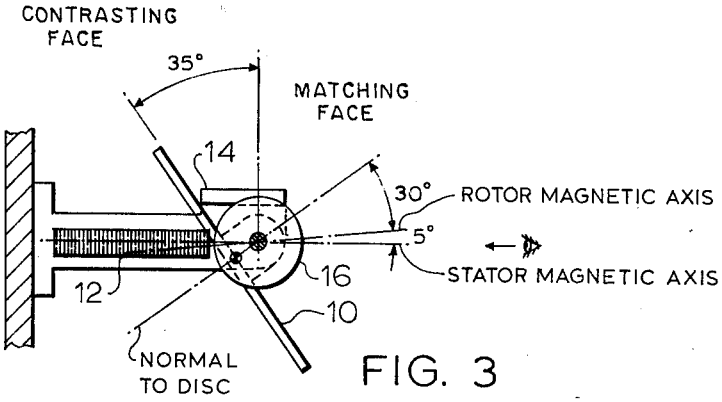
FIG. 3

GRAVITY BIAS FOR DISPLAY ELEMENTS

This invention relates to a rotatable element for use in magnetically operated, display or indicating devices.

The type of devices with which the development is used are those discussed in the U.S. Pat. Nos. 3,140,553 dated July 14, 1964; 3,283,427 dated Nov. 8, 1966; 3,295,238 dated Jan. 3, 1967; 3,365,824 dated Jan. 30, 1968 and 3,303,494 dated Feb. 7, 1967.

In these patents are shown display or indicating devices using one or more pivotally mounted elements each having a disc with contrasting surfaces on opposite sides, and each having mounted for rotation therewith, a magnet having the major component of its magnetic polar axis transverse to the axis of rotation. Means for producing a reversible magnetic field exterior to the rotatable element is provided, being arranged to switch the exterior field between two opposite or nearly opposite orientations to rotate the rotatable element through an angular range of between about 180° and about 135°. The disc therefore has a quiescent position at each end of the angular range, where one or the other contrasting faces is displayed in the viewing direction.

The disc is commonly circular but obviously does not have to be within the scope of the invention.

Such devices suffer from the disadvantages that with the rotatable element in one of its limiting positions, the reversal of the exterior field often does not supply a starting torque which is as large as desirable due to the alignment or near alignment of the exterior field and the element magnetic polar axis. The result may be non-functioning or unduly slow functioning of the rotatable element when the magnetic field is reversed.

In the past attempts have been made to overcome this by preventing alignment of the exterior and rotary magnet fields in either of the limiting or quiescent positions. This has been attempted by providing stops which limit rotation of the rotatable element short of the position where the magnetic fields would align or by providing a compound or resultant exterior field made up of the previously mentioned exterior field and a constant field perpendicular thereto. The result of reversal of the reversible exterior field is that the compound or resultant field is altered less than the full 180° with a corresponding reduction in the rotational angle of the rotatable element between limiting positions. Although both these alternatives have been successful to a degree, there has now been developed a technique, useful with certain types of display which is more economical and more successful with such displays.

The invention is thought to be of most frequent application with displays where the viewing direction is horizontal or nearly so. However the invention is applicable to and extends to displays where the viewing direction is other than horizontal. The display element comprises a disc contrastingly coloured on opposite sides. Since it is desired to discuss herein a disc which is flat or slightly bowed or otherwise slightly deformed from a flat plane, the term "median plane" is used herein to define the plane which most closely approximates the attitude of the surfaces of the disc.

In accord with the invention, the rotatable element or elements form part of an array defining a predetermined viewing direction. The contrasting sides of the rotatable element, and the background therefore in the viewing direction are coloured so that one side of the rotatable element tends to match the background and the other side of the rotatable element contrasts therewith. Stops are provided to limit the rotation of the rotatable element to an angular range terminating at one end in position where the matching surface is displayed in the viewing direction and at the other end in a position where the contrasting surface is displayed in the viewing direction. The stops must be designed so that the element in its position displaying its contrasting side has the median plane substantially perpendicular to the viewing direction because any substantial difference from this orientation is obvious to the viewer. However the stop defining the position of the rotatable element when the matching side is displayed may allow considerable deviation of the median plane from an attitude perpendicular to the viewing direction since such deviation is much less noticable. A reversible exterior field is provided, usually directed parallel to the viewing direction and reversible to control the position of the rotatable element. The rotating element assembly, comprising the disc and the magnet and the other rotating elements, is designed so that the centre of gravity of the rotatable element is eccentric relative to the pivotal axis in a direction which has a major component in the horizontal direction when the rotatable element is in either of its quiescent positions, i.e. displaying either the contrasting side or the matching side in the viewing direction. The sense of the eccentricity of the centre of gravity is selected so that the gravitational torque provided thereby, in either quiescent position, tends to rotate the rotatable element to the other quiescent position. The apparatus is designed so that, in each quiescent position, the element is controlled only by the magnetic torque exerted through the exterior field, the gravitational torque due to the eccentricity of the centre of gravity and the reaction of the relevant stop. The angle between the median plane of the disc and the polar axis of the rotatable element is selected having regard to the orientation (and strength) of the reversible field and the effect of the eccentricity so that the resultant of the magnetic and gravitational forces holds the element against the relevant stop in either quiescent position. It is found that it is more important that the element should be strongly held against the stop when the contrasting face is showing than when the matching face is showing since any 'flutter' of the element when in the contrasting quiescent position is more obvious to a viewer.

With the disc and associated elements designed and arranged as above described, the disc will, in each quiescent position have its magnetic polar axis, displaced from alignment with the reversible field in the direction of the other quiescent position. As a result a subsequent reversal of the exterior field, to reverse the disc orientation, causes the mangetic torque, and the gravitational torque (over at least the initial travel of the disc) to combine to move the disc toward its other quiescent position. The gravitational effects are larger at the start of rotation of the element from one position to the other when the magnetic torque is a minimum and the gravitational effects are smaller when in the mid-portion of the rotation when the magnetic torque approaches its maximum. Rapid and sure switching of the disc from one position to the other is therefore assured due to the gravitational and magnetic torques combining and the design is economical since the only requirement is the field, the stops, the magnet and disc with a suitable eccentricity in its centre of gravity.

Control of the disc orientation is achieved through an exterior reversible magnetic field. The disc is coloured to contrast with its background in one orientation and to match its background in the other orientation. When the contrasting side of the disc is showing in the viewing direction, the stop means (in the preferred embodiment) is designed to stop the disc with the median plane vertical and the reversible field and the orientation of the rotor magnet are designed so that the disc is biased firmly against the stop in this position. For this to be effective the angle between the magnetic axis of the rotary element and the relevant sense of the reversible field must, in the preferred embodiment, be at least about 25° to achieve the required torque pulling the disc onto the stop.

The 25° is measured from the sense of the reversible field toward the rotor magnet axis which measurement is in the direction of rotation of the disc toward its other position.

With the contrasting side of the disc perpendicular to the viewing direction in its contrasting orientation, (as it is in preferred forms of the invention), the orientation of the disc in its other position, that is with the side showing which matches the background, is limited by the fact that the rotation from the first quiescent position must be at least about 145° to ensure that the contrasting side of the disc is (in this orientation) masked for viewers in most positions. On the other hand, an angle of at least about 5° is required in the matching orientation between the axis of the rotor magnet and the relevant sense of the reversible exterior field to cause the disc to be pulled against its stop. Geometrical analysis will show that the maximum rotation of the disc is limited to about 150°.

In the drawings:

FIG. 1 shows a perspective view of a display incorporating the invention and showing elements in a matching and in a contrasting orientation;

FIG. 2 shows in side view a display element oriented to display in the viewing direction, the side which contrasts with the background;

FIG. 3 shows in side view the apparatus of FIG. 1 with the disc displaying in the viewing direction the side which matches the background.

The preferred embodiment of the invention describes an array which is vertically arranged so that the viewing direction is horizontal. This is thought to be the most common application of the gravity biasing techniques and designs of the invention. It will be noted that the invention extends, however, to displays which are not vertical and to viewing directions not horizontal, and the invention is limited only by the invention as broadly defined previously and described in the appended claims.

In the drawings, the apparatus shown forms part of a display facing horizontally to the right and intended to be viewed horizontally or within 55° above or below. The disc 10 is pivotally mounted on a support and the support is coloured as viewed in the viewing direction to provide a certain colour (usually black) as a background for the disc. The disc is coloured on one side (to the right in the Figures) to contrast with the background and on the other side to match the background.

The support for the disc includes the pole piece 12 for providing a horizontal exterior field which is reversible to act in either horizontal sense, a pivotal mounting for the disc and stop means 14 to contact and stop the disc at a predetermined point in its travel either toward the position of FIG. 2 or toward the position of FIG. 3, thus acting as two stops. Two separate stop means could of course be used.

The pivotally mounted disc is coloured as described. The pivot axis extends transverse to the viewing direction. The disc, usually of metal or plastic, is shaped or molded so that the disc assembly centre of gravity C.G. is eccentric in the direction normal to the median plane of the disc.

A magnet 16 is mounted on the disc for rotation therewith defines a magnetic axis (rotor axis) as shown and forms part of the disc assembly.

The disc 10 and magnet 16 rotate together and form the disc assembly, and are mounted for free pivotal rotation in the shaft 17 which in turn is mounted on the support for the array.

The disc is shown as planar but may deviate slightly from this to bowed or dimpled shapes for structural or construction reasons for example as shown in co pending application Ser. No. 563,227 filed Mar. 28, 1975 or Ser. No. 605,303 filed Aug. 18, 1975 and owned by the assignee herein. The term 'median plane' therefore means the plane which most closely approximates the contour of the disc.

When the contrasting side of disc 10 is showing in the viewing direction the viewer is conscious of slight changes of angle. Therefore it is important that the stop means act to stop rotation of the disc when the median plane is vertical with the contrasting face outwardly, as shown in FIG. 2.

The reversible exterior field will be horizontal in either sense. To ensure that the disc in the position of FIG. 2 is pulled firmly against the stop the angle between the rotor axis and the external field should at least be 25° and is preferably 30° as shown. The orientation of the magnetic axis of rotor magnet 16 is thus narrowly determined by these criteria.

When, with the exterior field holding the disc in the position of FIG. 2 it will be understood that the resultant torque on the rotor magnet due to the exterior magnetic field and gravity is leading to pull it against forward side of the stop means 14.

When the exterior field sense is reversed, the combination of gravity and the reversed magnetic torque rotates the display element (clockwise in the drawings) from the position shown in FIG. 2 to the position shown in FIG. 3. The exterior field is so designed relative to the gravitational torque and the orientation of rotor magnet 16 that when the disc is stopped in the position of FIG. 3 by the rear of stop means 14 the median plane of the disc is within 35° of the vertical plane. This angle is selected so that the viewers looking upward at angles up to 55° will not see the contrasting surface of the disc. FIG. 3 represents the attitude of the rotatable element with the visible face of the rotatable element matching the background. In the orientation of FIG. 3 the disc median plane cannot approach much closer to the vertical because at least about 5° is required between the rotor magnet axis and the exterior field axis to provide sufficient magnetic torque to hold the disc against stop 14.

The exterior field, the magnet and the centre of gravity are designed so that the rearward side of stop means 14, in the position of FIG. 3 is stopping the disc short of the position it would naturally assume under the influences of the magnetic and gravitational forces, so that the disc is biased against the stop. In order to ensure sufficient magnetic torque for these purposes, the angle between the axis of magnet 16 and the exterior field should be at least 5°.

With the rotatable element in the attitude of FIG. 3 it will be noted that the gravitational torque on the rotatable element, supplied by the eccentricity of the centre of gravity, is in a direction to tend to turn the rotatable element toward its contrasting position as shown in FIG. 2. Thus, with the rotatable element in the attitude of FIG. 3, when it is desired to switch the element to expose its contrasting side, the exterior field is reversed by reversing the energization of stator 12. On such reversal both the magnetic and the gravitational torque, drive the element in the same direction, i.e. rotate it to the position of FIG. 2.

Although it is not directly relevant to the invention it is noted that the retention of the element in the positions of FIGS. 2 or 3 is due to the maintenance of the field from stator electro-magnet 12. Although this can be achieved by a continuous current in the energizing coils (not shown) for electro-magnet 12, it is preferable that the core 12 be selected from well known materials which, although their magnetic polarity may be reversed, have a relatively large remanence flux after the electrical energizing current may be provided in pulse form, to switch the polarity of the core of electro-magnet 12. Once switched the energizing current may be turned off until it is again desired to reverse the polarity of the core.

By way of explanation it should be noted that, without deterioration in appearance of the display, a much greater deviation of the median plane from the vertical may be tolerated when the side of the disc matching the background is displayed, than when the contrasting side is seen. Thus the median plane should be vertical when the contrasting side of the disc is showing but may be about 35° off the vertical when the matching side is showing.

Further vibration of the disc when the contrasting side is showing less tolerable than with the matching side. Thus a 25° – 30° angle is required between the rotor magnet and the exterior field in the position of FIG. 2 to supply greater magnetic pull on the disc against stop 14, whereas a lesser magnetic pull is required in the orientation of FIG. 3, hence only about a 5° angle is required between the rotor magnet axis and the exterior field.

Although the most obvious uses and the preferred embodiment are described in relation to an horizontal viewing direction, the invention extends to viewing directions which are of other orientations, including vertical. The criteria are that in relation to the viewing direction the median plane of the rotary element must be very nearly perpendicular to the viewing direction when the contrasting side is displayed. However when the side of the rotatable element matching the background is displayed, the deviation of the median plane from the perpendicular to the viewing direction may be much greater without undue deterioration of the appearance of the display. The 'matching' orientation of the element, therefore, has a deviation from perpendicularity of the median plane to the viewing direction controlled mainly by the requirement that the contrasting side of the element should not be visible from a selected range of viewing positions.

In each of the matching and the contrasting positions, the rotary element will be biased against stops provided by the combination of magnetic and gravitational. Thus the element must be designed, having regard to the viewing direction, so that its eccentricity relative to the pivot axis of the rotatable element provides a centre of gravity which in turn provides a torque in either stopped position tending to rotate the rotary element through the allowed rotation direction to the other stopped position.

Given the viewing direction the stop positions and the gravitational eccentricity, the reversible field and the rotational magnet will be located and oriented to bias the rotatable element against the stop in each quiescent position and to cause rotation from one quiescent position to the other on reversal of the exterior field.

We claim:

1. A rotatable element for a display or indicator defining a predetermined viewing direction comprising:

a relatively thin disc, contrastingly coloured on opposite sides, the disposition of said disc defining a median plane, means for pivotally mounting said disc on a support defining a pivotal axis therefore approximately parallel to such median plane, a magnet mounted for rotation with said disc defining a magnetic polar axis having its major component transverse to said axis of rotation, said disc, magnet and members rotating therewith defining a disc assembly, said disc assembly being designed so that the centre of gravity thereof is eccentric relative to said pivotal axis, stop means allowing rotation of the disc only between a first and second limiting position separated by greater than 90° and less than 180°, said first position corresponding to an orientation of said median plane substantially perpendicular to said viewing direction, said disc assembly being so designed that said eccentricity in either stopped position of the element tends to move the rotatable element toward the other stopped position in the allowable direction of rotation, and means for providing a reversible magnetic field exterior to said element designed in opposite senses to rotate said disc to opposite ends of said range of movement.

2. A rotatable element for a display or indicator comprising:

a relatively thin disc, contrastingly coloured on opposite sides, the disposition of said disc defining a median plane, means for pivotally mounting said disc on a support, defining a pivotal axis approximately parallel to such median plane, a magnet mounted for rotation with said disc defining a magnetic polar axis having its major component transverse to said axis of rotation, said disc, magnet and members rotating therewith comprising a disc assembly, said disc assembly being designed so that the centre of gravity thereof is eccentric relative to said pivotal axis in a direction substantially normal to said median plane, stop means associated with said support for limiting rotation of said rotatable element to movement between two limiting positions between 90° and 150° apart.

wherein said support defines a horizontal viewing direction and said stop means and rotatable element is designed so that in one of said limiting positions, the median plane is vertical with the centre of gravity outward in the viewing direction from the pivot axis and in the other limiting position, the centre of gravity has moved downward from said one position; and there is provided an exterior reversible magnet field arranged and oriented so that in each sense it will move said rotatable elements to one of said limiting positions.

* * * * *